US007540063B2

(12) United States Patent
Petner

(10) Patent No.: US 7,540,063 B2
(45) Date of Patent: Jun. 2, 2009

(54) COMBINATION MOP WRINGER AND BUCKET SYSTEM

(75) Inventor: Robert E. Petner, Burlington, NJ (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 0 days.

(21) Appl. No.: 12/154,966

(22) Filed: May 28, 2008

(65) Prior Publication Data

US 2008/0282493 A1 Nov. 20, 2008

Related U.S. Application Data

(62) Division of application No. 10/970,080, filed on Oct. 21, 2004.

(51) Int. Cl.
*A47L 13/50* (2006.01)
*A47L 13/58* (2006.01)

(52) U.S. Cl. ..... 15/260; 15/264

(58) Field of Classification Search ..... 15/260, 15/261, 264

See application file for complete search history.

(56) References Cited

U.S. PATENT DOCUMENTS

| | | | | | |
|---|---|---|---|---|---|
| 348,609 | A * | 9/1886 | Allen | 15/262 |
| 456,666 | A * | 7/1891 | White | 15/261 |
| 697,223 | A * | 4/1902 | Towne | 15/261 |
| 1,831,135 | A * | 11/1931 | Pehrsson | 15/261 |
| 2,127,045 | A * | 8/1938 | Pavek | 15/261 |
| 2,579,054 | A * | 12/1951 | Scott | 15/261 |
| D255,976 | S * | 7/1980 | Maza et al. | D32/54 |
| 5,070,574 | A * | 12/1991 | Delmerico et al. | 15/261 |
| 5,440,778 | A * | 8/1995 | De Guzman | 15/260 |
| D362,941 | S * | 10/1995 | Delmerico et al. | D32/53 |
| 5,548,865 | A * | 8/1996 | Pagani | 15/262 |
| 5,608,942 | A * | 3/1997 | Disbrow | 15/261 |
| 5,615,446 | A * | 4/1997 | Cetnarowski | 15/261 |
| 5,918,343 | A * | 7/1999 | Young | 15/262 |
| 5,974,621 | A * | 11/1999 | Wilen | 15/261 |
| 6,006,397 | A * | 12/1999 | Williams et al. | 15/261 |
| 6,279,195 | B1 * | 8/2001 | Biggs | 15/261 |
| 6,671,923 | B2 * | 1/2004 | Gromnicki | 15/261 |

* cited by examiner

*Primary Examiner*—Randall Chin
(74) *Attorney, Agent, or Firm*—Stuart M. Goldstein

(57) ABSTRACT

A combination wringer/bucket system uses a wringer consisting of a wringer basket and pressure plate, specifically configured to be mounted on the rim of the bucket, which itself is specially adapted to receive and support a separable, columnar wringer basket support member. This member extends between the floor of the bucket and the basket and provides stability to the bucket mounted wringer. The support member can be removed from the bucket, as can the wringer, so that the bucket can be used alone, if desired. For providing additional stability to the wringer, leg components extend from the pressure plate, through the wringer basket. A cam operated system smoothly controls the movement of the pressure plate within the wringer, to efficiently and effectively wring out saturated mops.

5 Claims, 8 Drawing Sheets

COMBINATION MOP WRINGER AND BUCKET SYSTEM

RELATED APPLICATION

This application is a divisional of parent application Ser. No. 10/970,080, filed on Oct. 21, 2004 now pending.

BACKGROUND OF THE INVENTION

Mop wringer/bucket combination systems are widely used in floor cleaning and swabbing operations, especially in, but not limited to, commercial environments. In normal practice, once the swab type mop employed to clean or mop a floor has become saturated, it is inserted into the wringer, where its moisture is squeezed out of the mop strands and into the bucket which mounts the wringer. The mop is then withdrawn from the wringer for further mopping. This basic system is also commonly used to clean floor surfaces when there is a cleaning liquid in the bucket. The swab mop is inserted into the bucket to soak in the liquid and is then put through the wringer to shed its excess liquid before being used on the floor.

There are many such commonly used wringer/bucket combination systems, some of which are disclosed in U.S. Pat. Nos. 5,070,574, 5,440,778, 5,548,865, 5,615,446, 5,974,621, and 6,671,923. However, while some of these prior systems are effective in performing the mop wringing function, they are generally unstable, given the top heavy design of the wringer on the bucket. The very mounting of the wringer on the rim of the bucket results in the wringer being unsteady. This instability is exacerbated when the mop is inserted into the wringer; buckets, with wringers attached, often tip over, especially during this use. Further, most of the prior systems have a substantial number of connecting and moving parts which are prone to wear and failure. This, of course, makes the system inefficient over the life of the mop and bucket unit.

SUMMARY OF THE INVENTION

It is thus the object of the present invention to overcome the disadvantages and deficiencies of prior combination wringer and bucket system.

It is an object of the present invention to provide a combination wringer and mop bucket system which has components compatibly designed for use.

It is a further object of the present invention to provide a combination wringer and mop bucket system which provides stability to the system, especially when a mop is inserted into the system's wringer.

It is still another object of the present invention to provide a combination wringer and mop bucket system which employs a component which is separable from the wringer and bucket, but configured to support the wringer in relation to the bucket and provide stability to the system.

It is a further object of the present invention to provide a combination wringer and mop bucket system which comprises means in the form of leg components extending from the wringer to provide additional stability while the wringer is in use.

It is another object of the present invention to provide a combination wringer and mop bucket system which uses a cam system with a minimum of parts to smoothly control the movement of the pressure plate within the wringer and thus efficiently wring out saturated mops.

It is still another object of the present invention to provide a combination wringer and mop bucket system which has removeable components which allow the bucket to be used separately.

It is a further object of the present invention to provide a combination wringer and mop bucket system which has a minimum number of parts and which is easy to manufacture and assemble.

These and other objects are accomplished by the combination wringer/bucket system of the present invention. The system uses a wringer consisting of a wringer basket and pressure plate, specifically configured to be mounted on the rim of the bucket, which itself is specially adapted to receive and support a separable, columnar, wringer basket support member. This member extends between the floor of the bucket and the basket and provides stability to the bucket mounted wringer. The support member can be removed from the bucket, as can the wringer, so that the bucket can be used alone, if desired. For providing additional stability to the wringer, leg components extend from the pressure plate, through the wringer basket. A cam operated system smoothly controls the movement of the pressure plate within the wringer, to efficiently and effectively wring out saturated mops.

The novel features which are considered as characteristic of the invention are set forth in particular in the appended claims. The invention itself, however, both as to its design, construction, and use, together with additional features and advantages thereof, are best understood upon review of the following detailed description with reference to the accompanying drawings.

DETAILED DESCRIPTION OF THE INVENTION

Figure 1:
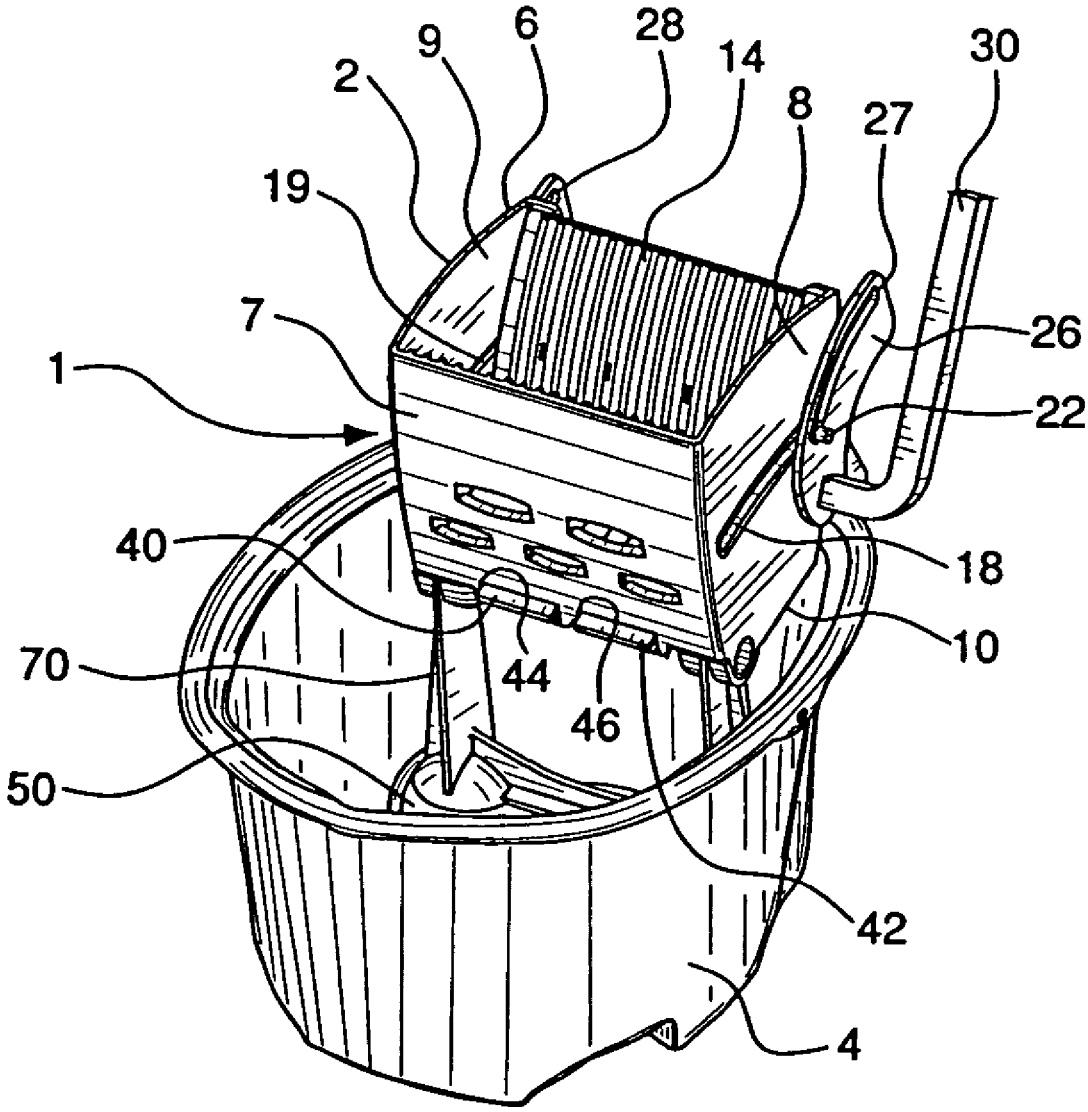
FIG. 1 is a perspective view of the mop wringer and bucket system of the present invention.
Figure 2:
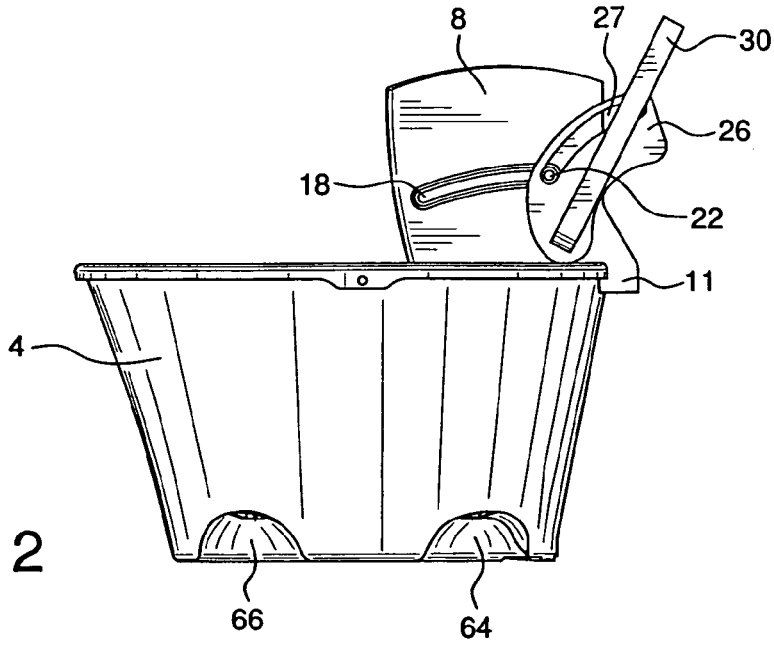
FIG. 2 is an elevation view of the system of the present invention.
Figure 3:
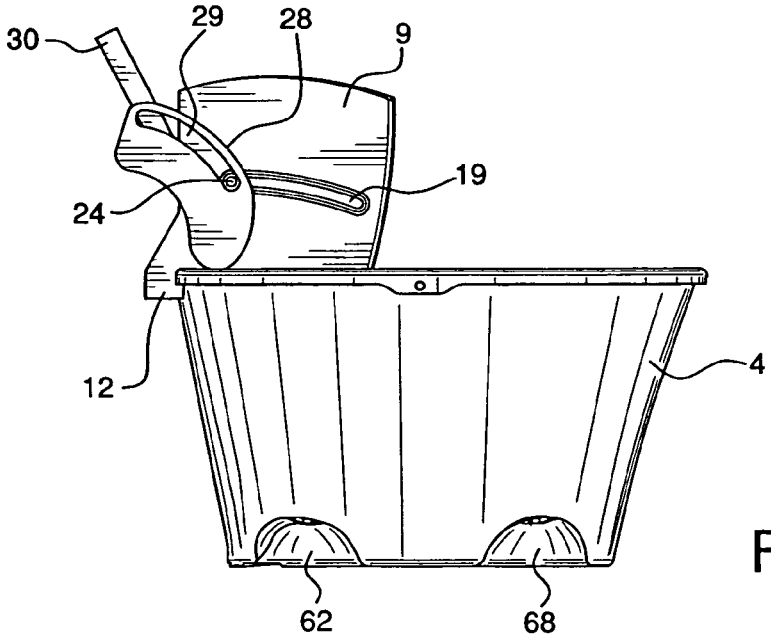
FIG. 3 is the other elevation view of the system of the present invention.
Figure 4:
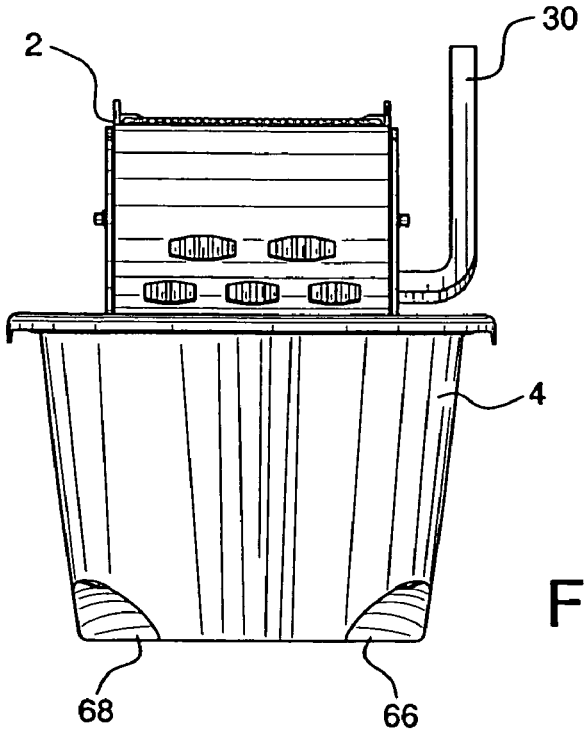
FIG. 4 is a front view of the system of the present invention.
Figure 5:
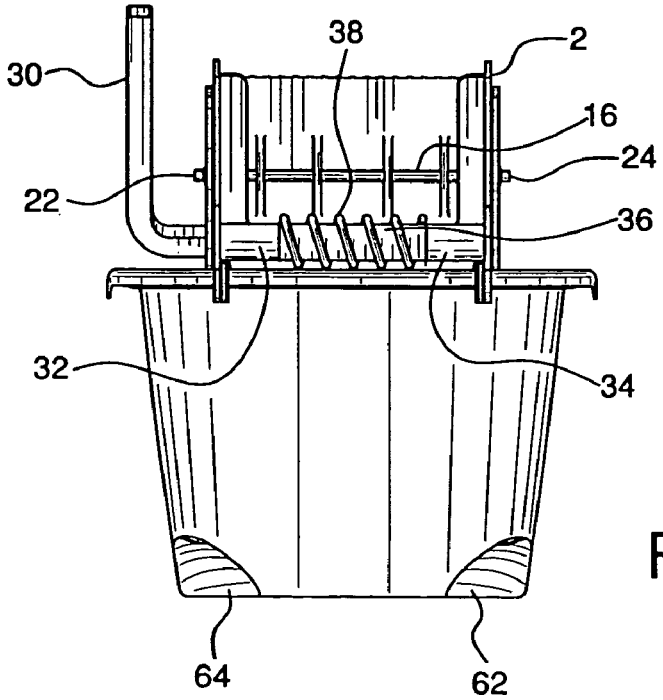
FIG. 5 is a rear view of the system of the present invention.
Figure 6:
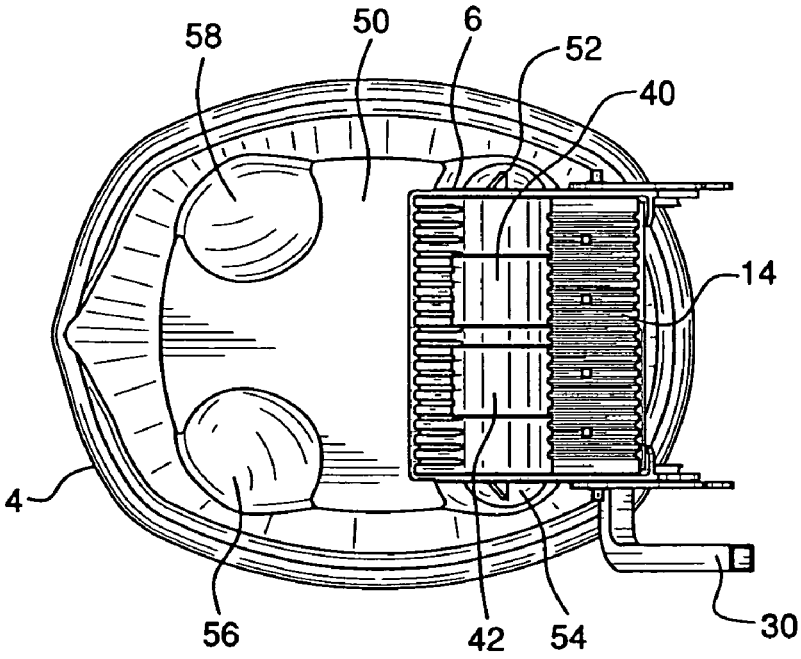
FIG. 6 is a top view of the system of the present invention.
Figure 7:
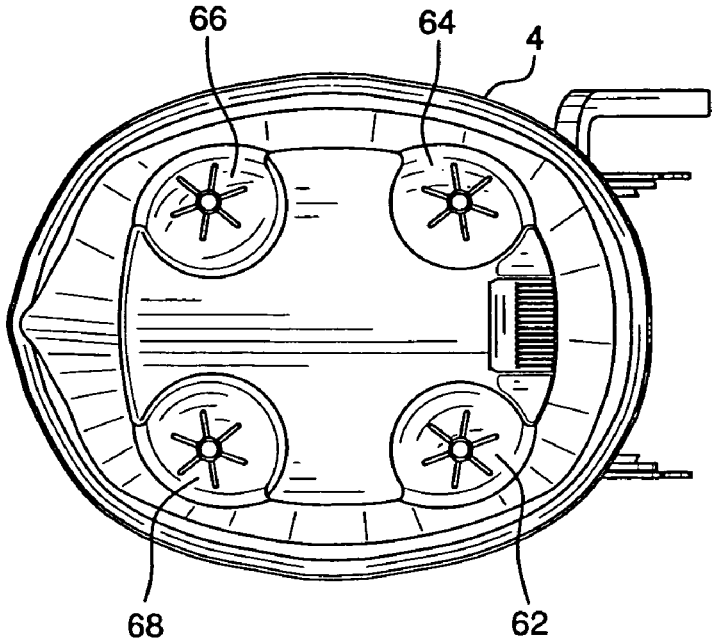
FIG. 7 is a bottom view of the system of the present invention.
Figure 8:
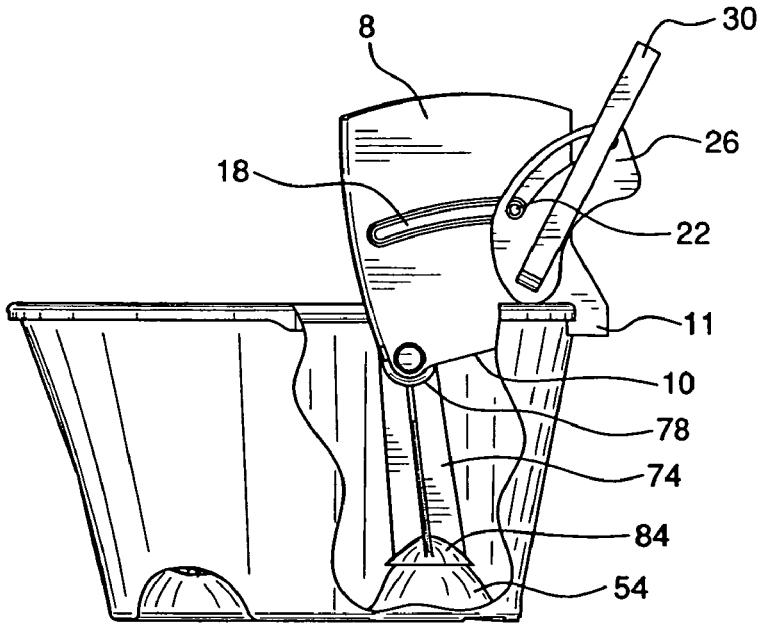
FIG. 8 is a partial, cut-out elevation view of the system of the present invention.
Figure 9:
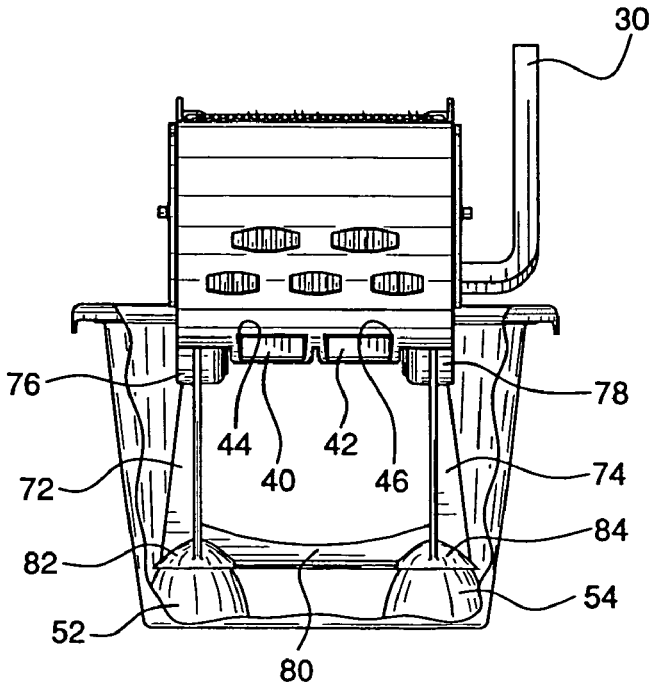
FIG. 9 is a partial, cut-out front view of the system of the present invention.
Figure 10:
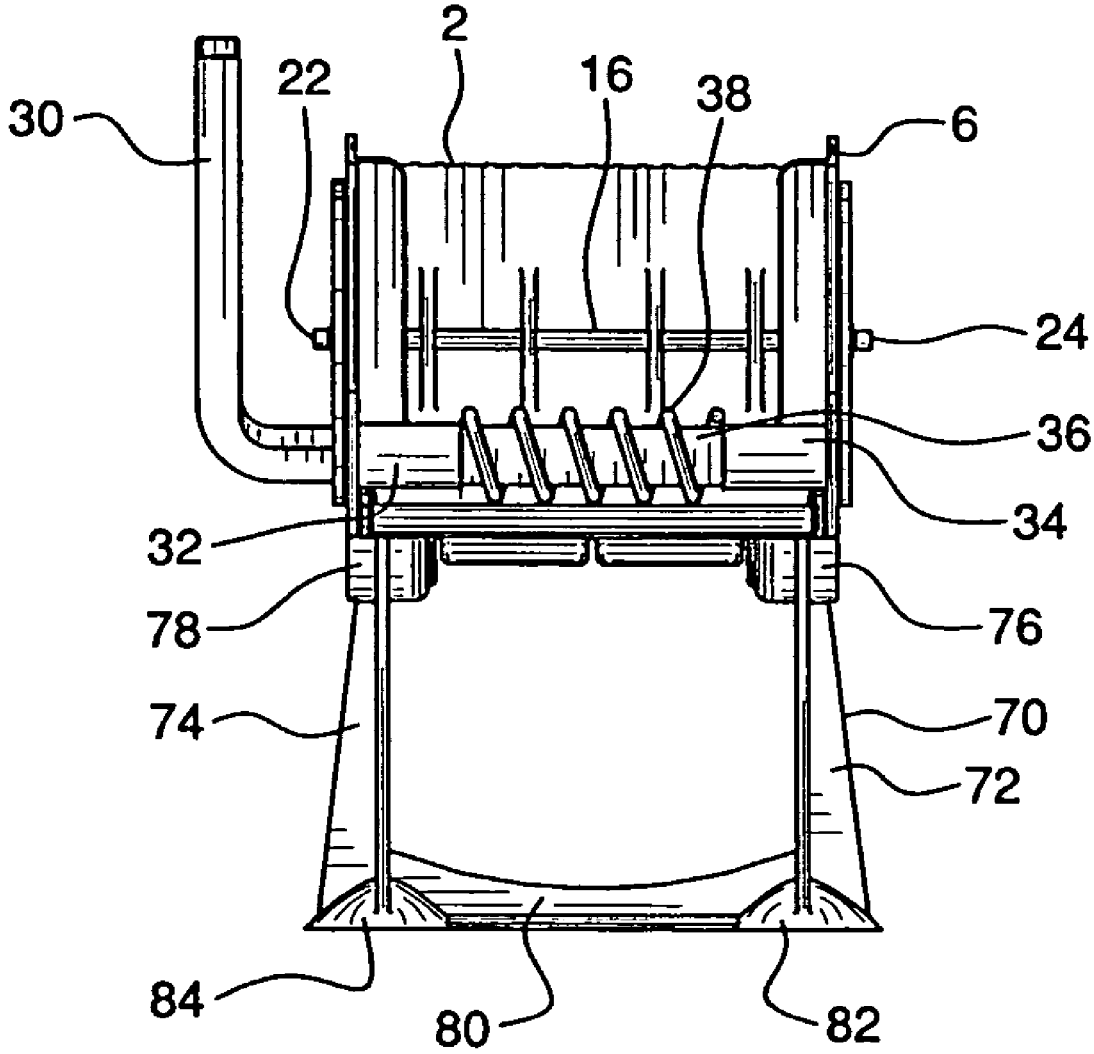
FIG. 10 is a rear view of the wringer and columnar support member, separable components of the system of the present invention.
Figure 11:
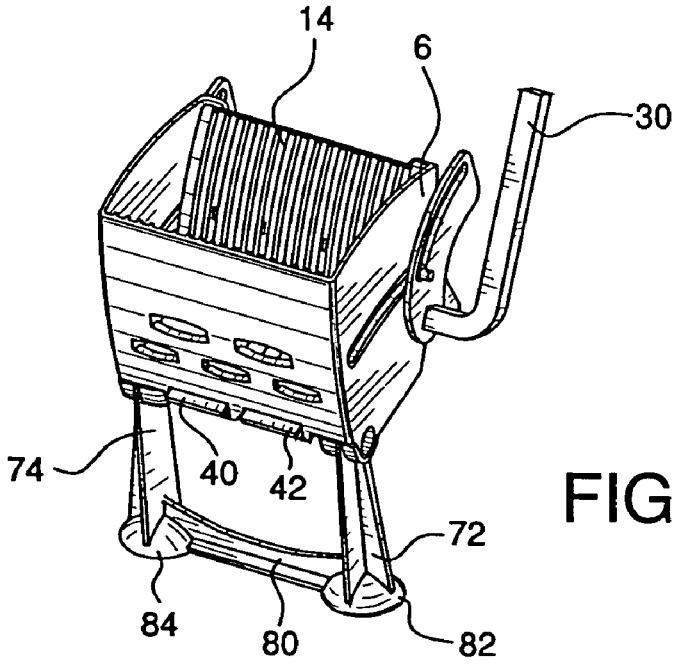
FIG. 11 is a perspective view of the wringer and columnar support member, components of the present invention, with the wringer handle in an upright position and the basket opened.
Figure 12:
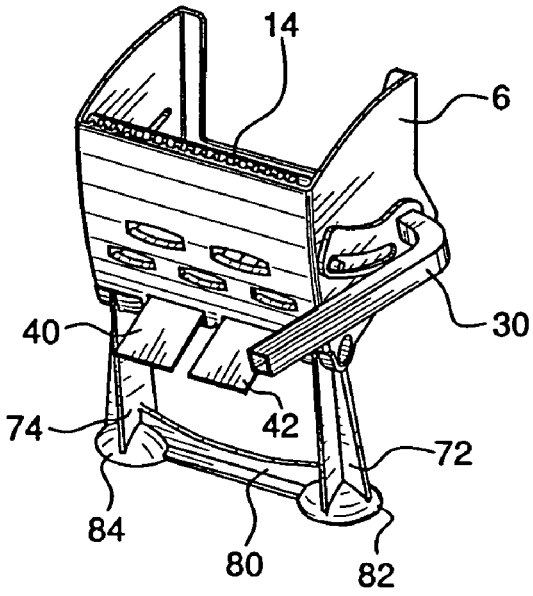
FIG. 12 is a perspective view of the wringer and columnar support member, components of the present invention, with the wringer handle in a down position, having moved the pressure plate for mop wringing operations.
Figure 13:
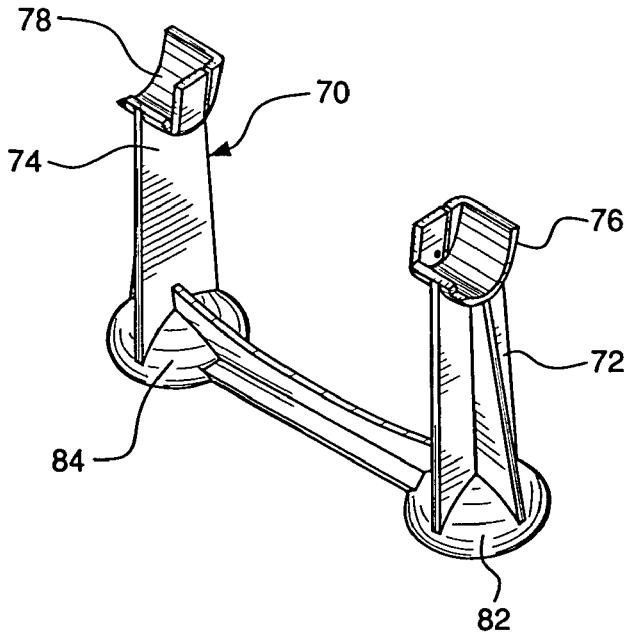
FIG. 13 is a perspective view of the columnar support member component of the system of the present invention.
Figure 14:
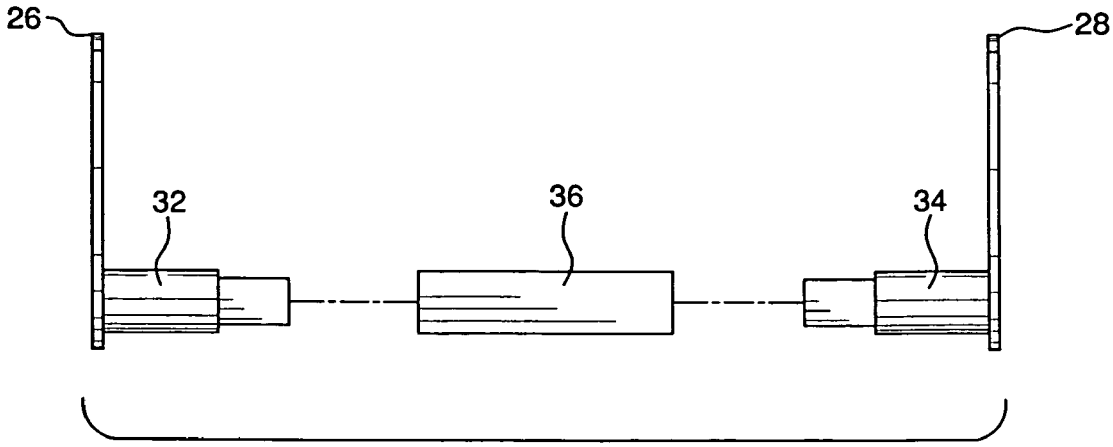
FIG. 14 shows the manner in which the connecting tube and cam arm members of the system of the present invention are connected.

The wringer/bucket system 1 of the present invention consists of a mop wringer 2 and mop bucket 4. Wringer 2 comprises wringer basket 6 with front surface 7, side surfaces 8 and 9, and bottom surface 10. Basket 6 is substantially open between side surfaces 8 and 9. Pressure plate 14 extends into basket 6 and is mounted within the basket by a cam type system which comprises rod 16 positioned within arcuate slots 18 and 19 located in side surfaces 8 and 9 respectively. Rod 16 is mounted within slots 18 and 19 by means of capped bearings 22 and 24. Rod 16 is positioned adjacent to and extends across the rear surface of pressure plate 14, as seen in FIG. 5, and is configured to be moveable up and down within slots 18 and 19.

The cam type system also includes dual slotted cam components 26 and 28. Substantially upwardly extending handle 30 is connected to cam component 26. The ends of rod 16 and its bearings 22 and 24 extend through slots 27 and 29 in cam components 26 and 28, respectively.

Extending from the lower regions of cam components 26 and 28 are cam arms 32 and 34 respectively. Arms 32 and 34 are inserted into connecting tube 36, which thereby mounts cam components 26 and 28 onto the back, lower part of basket 6. Spring 38 substantially surrounds connecting tube 36 and is positioned to apply a compressive bias force against pressure plate 14. Handle 30 is normally in a substantially upright position. However, forward movement of handle 30 acting against the bias of spring 38, moves rod 16 forward within arcuate slots 18 and 19 and slots 27 and 29 in cam components 26 and 28. Movement of rod 16 against the rear surface of pressure plate 14 compels the pressure plate forward against the compressive force from spring 38. As pressure plate 14 is moved forward, it serves to squeeze fluid from the strands of the mop which is inserted between the pressure plate and front surface 7 of basket 6.

Emanating outward from pressure plate 14 are two leg members 40 and 42. These leg members extend through slotted openings 44 and 46, located at the bottom of front surface 7 of basket 6. This configuration provides a substantial measure of anti-rotational stability to system 1, when a mop is inserted into basket 6 and pressure plate 14 is compelled forward by handle 30 to effect the wringer action on a mop.

Mop bucket 4, while an integral component of system 1, can also be used by itself, for common bucket uses. Bucket 4 has floor surface 50 which comprises bucket base members 52, 54, 56, and 58, which are concave when viewed from inside the bucket. From outside bucket 4, the surfaces of base members 52, 54, 56, and 58 appear convex and form wheel wells 62, 64, 66, and 68, into which optional bucket wheels can be mounted.

When wringer 2 and bucket 4 are to be used in combination as system 1, basket 6 is removeably mounted on the rim of bucket 4 by means of hooked arms 11 and 12 extending from the basket. In order to ensure that basket 6 has adequate support while it is mounted on the rim of bucket 4, columnar support member 70 is provided. Member 70 comprises dual interconnected columns 72 and 74 and is configured to extend between floor surface 50 of bucket 4 and bottom surface 10 of basket 6. Each column 72 and 74 has basket support elements 76 and 78 at their respective upper ends configured to accept and support the lower corners of basket 6. Interconnecting member 80 extends between columns 72 and 74. Bucket receptacle members 82 and 84, located at the lower ends of columns 72 and 74, are convex in nature and are configured for ready placement on concave bucket base members 52 and 54. Columnar support member 70 is formed as a unitary component and, like wringer 2, is separable and removable from bucket 4. However, when member 70 is in place between mop floor surface 50 and basket 6, it provides added support to maintain the stability of wringer 2, on bucket 4, even when a mop is in the basket and being squeezed by pressure plate 14 of the wringer.

Thus system 1 consists of main elements, wringer 2, bucket 4 and columnar support 70, which are easily assembled and, when the bucket is to be used separately, easy to disassemble. The elements are also relatively simple and economical to manufacture and even wringer 2, which has relatively few parts, has components which can be readily manufactured and easily and quickly assembled.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A wringer and mop bucket combination comprising:

(a) a wringer having a basket with a bottom surface and lower corners;

(b) a mop bucket with a floor surface;

(c) means for supporting the wringer basket in spaced relation to the mop bucket, said supporting means comprising free standing columnar support members having upper and lower ends, each columnar support member having a wringer basket support element at its upper end configured to conform to the shape of one of the lower corners of the wringer basket, to receive and support the wringer basket, wherein the wringer basket merely sits and rests on the wringer basket support elements, and a mop bucket receptacle member at its lower end configured to conform to the shape of the floor surface of the mop bucket, said wringer basket supporting means located completely within the mop bucket and extending between the bottom surface of the wringer basket and the floor surface of the mop bucket; and (d) bucket base members defining projections on the floor surface of the bucket which are received in the respective mop bucket receptacle members to maintain the wringer basket supporting means in stable, stationary position within the mop bucket.

2. The wringer and mop bucket combination as in claim 1 wherein the wringer basket supporting means comprises a component which is independent of the wringer basket and the bucket and is totally separable and removeable from the wringer basket and the bucket.

3. The wringer and mop bucket combination as in claim 1 wherein there are two columnar support members.

4. The wringer and mop bucket combination as in claim 1 wherein the bucket base members comprises concave base members.

5. The wringer and mop bucket combination as in claim 4 wherein the mop bucket receptacle members are configured for placement over the concave base members.

* * * * *